United States Patent [19]

Seki et al.

[11] 4,043,233

[45] Aug. 23, 1977

[54] METHOD OF PREVENTING MULTI-SHEET FEEDING

[75] Inventors: Masao Seki; Hidetoshi Kito; Masaki Yoshino, all of Ebina, Japan

[73] Assignee: Rank Xerox Ltd., London, England

[21] Appl. No.: 722,891

[22] Filed: Sept. 13, 1976

[30] Foreign Application Priority Data

Dec. 3, 1975 Japan ..... 50-142842

[51] Int. Cl.[2] ..... B65H 3/00; B26D 3/02

[52] U.S. Cl. ..... 83/23; 83/29; 83/581

[58] Field of Search ..... 83/23, 27, 29, 581

[56] References Cited

U.S. PATENT DOCUMENTS 3,546,990 12/1970 Schneider ..... 83/27

*Primary Examiner*—Willie G. Abercrombie

*Attorney, Agent, or Firm*—James J. Ralabate; Clarence A. Green; William A. Henry

[57] ABSTRACT

A method of preventing double-sheet feeding within copiers or printing machines and the like comprising the steps of (1) cutting the paper in an inclined direction and then (2) arranging the inclined ends of the paper at right angles to each other to thereby separate the sheets.

4 Claims, 5 Drawing Figures

METHOD OF PREVENTING MULTI-SHEET FEEDING

BACKGROUND OF THE INVENTION

This invention relates to laminated paper used with copiers or printing presses and the like and more particularly to a method of preventing double-sheet feeding of laminated paper.

Heretofore, laminated paper has been cut for size by a cutter 1 at right angles to a paper surface 2 as shown in FIG. 1 (*a*) and therefore, what is called "burrs" 3 are produced as shown in FIG. 1 (*b*) in cut portions of sheets laminated, resulting in intimate contact therebetween to cause double-feeding of paper when the latter is used in copiers and the like.

The present invention is directed to solving the above problem and has as an object the providing of laminated paper which eliminates the cause of double-feeding due to "burrs" produced at the time of cutting.

Yet another object of the present invention is to remove "welds" between sheets of paper created as a result of cutting the sheets to size.

SUMMARY OF THE INVENTION

A method of preparing sheets for feeding that substantially eliminates multi-sheet feeding due to welds formed between sheets as they are cut to a particular size comprising the steps of: cutting the sheets at an angle with respect to a top surface of the sheets, and reciprocating the sheets on their ends remote from the cutting area whereby welds formed between the sheets during cutting to size are separated and as a result multi-sheet feeding is substantially eliminated.

BRIEF DESCRIPTION OF THE DRAWINGS

For a better understanding of the invention as well as other objects and further features thereof, reference is had to the following detailed description of the invention to be used in conjunction with accompanying drawings, wherein.

DESCRIPTION OF THE PREFERRED EMBODIMENT

Figure 1A:
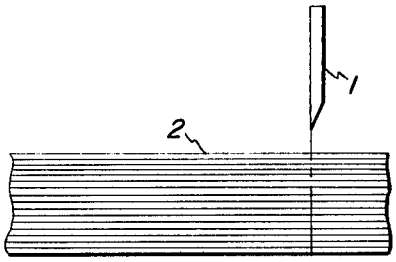
PRIOR ART FIG. 1a
FIGS. 1 (*a*) and (*b*) are views of conventional laminated paper cutting and resulting "burrs."
Figure 1B:
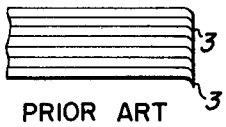
PRIOR ART FIG. 1b
Figure 2:
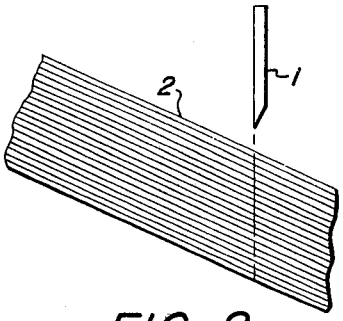
FIG. 2 is a side view showing paper being cut according to the present invention.

The present invention can be used whenever paper is required to be cut and subsequently fed by sheet feeding mechanisms. However, for the purpose of exemplary disclosure, the invention will be described within the environment of copiers and printing presses or the like. In order to cut laminated paper in a direction inclined with respect to a paper surface 2, as shown in FIG. 2, cutting may be carried out with the entire laminated paper obliquely supported in a condition where a cutter 1 is perpendicular or vertical with respect to the paper surface 2, or with the entire laminated paper horizontally supported and the cutter 1, inclined.

Figure 3:
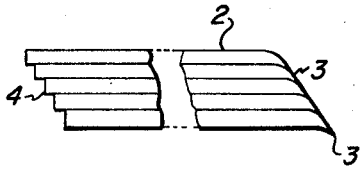
FIG. 3, is a side view of sheets as they appear after having been cut according to FIG. 2.
Figure 4:
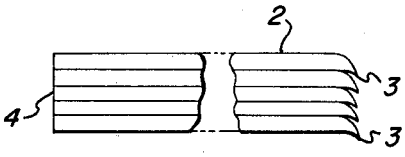
FIG. 4, is a side view of the sheets after they have been rearranged at right angles to each other.

After cutting has been made, cut sheets assume an offset position as shown in FIG. 3. In order to remove the "welds" or "burrs" produced from the cutting of the sheets as shown in FIG. 3, they are arranged approximately at right angles to the paper surface 2 as shown in FIG. 4 thereby separating the sheets and substantially eliminating multi-sheet feeding once the sheets are fed into a copier or printing press or the like.

The sheets are best separated by reciprocating the sheets up and down on their ends opposite or removed from the cutting area or end.

From the foregoing description of the present invention, it will be appreciated that when laminated paper is used with copiers or printed presses or the like, intimate contact due to "burrs" 3 produced at the time of cutting may be removed to thereby prevent double-feeding caused by the "burrs" with the use of the method disclosed herein of cutting the sheets at an angle with respect to the surface of the sheets and subsequently reciprocating the sheets on their ends to separate the "burr."

In addition to the method outlined above, many other steps or modifications and/or additions to this invention will be readily apparent to those skilled in the art upon reading this disclosure, and these are intended to be encompassed within the invention disclosed and claimed herein.

What is claimed is:

1. A method of preventing double-sheet feeding from a stack of sheets comprising the steps of: (a) cutting the sheets at an incline with respect to the plane of the stack of sheets; and (b) arranging offset ends of the sheets formed from the inclined cutting of the sheets approximately at right angles to the surface of the sheets.

2. The method of claim 1, wherein the sheets are supported horizontally and are cut at an incline.

3. The method of claim 1, wherein the sheets are supported on an incline and are cut with a vertical blade.

4. A method of preparing sheets for feeding that substantially eliminates multi-sheet feeding due to burrs formed as the sheets are cut for size, comprising the steps of: cutting the sheets at an incline with respect to a surface of the sheets; and (b) reciprocating the sheets on their ends removed from the cut whereby burrs formed along the cut are separated so as to enhance individual sheet feeding.

* * * * *